US011529746B2

(12) United States Patent
Smith

(10) Patent No.: US 11,529,746 B2
(45) Date of Patent: Dec. 20, 2022

(54) RAZOR BLADE HEAD AND RAZOR FOR USE THEREWITH

(71) Applicant: Jerome Robert Smith, Raanana (IL)

(72) Inventor: Jerome Robert Smith, Raanana (IL)

( * ) Notice: Subject to any disclaimer, the term of this patent is extended or adjusted under 35 U.S.C. 154(b) by 0 days.

(21) Appl. No.: 17/239,722

(22) Filed: Apr. 26, 2021

(65) Prior Publication Data

US 2021/0339414 A1 Nov. 4, 2021

Related U.S. Application Data

(60) Provisional application No. 63/019,473, filed on May 4, 2020.

(51) Int. Cl.

| | |
|---|---|
| ***B26B 21/40*** | (2006.01) |
| *B26B 21/06* | (2006.01) |
| *B26B 21/22* | (2006.01) |

(52) U.S. Cl.

CPC ..... *B26B 21/4012* (2013.01); *B26B 21/06* (2013.01); *B26B 21/225* (2013.01)

(58) Field of Classification Search

None

See application file for complete search history.

(56) References Cited

U.S. PATENT DOCUMENTS 3,078,569 A * 2/1963 Sidney ..... B26B 21/06 30/526
5,070,612 A * 12/1991 Abatemarco ..... B26B 21/4018 30/83
6,792,682 B2 * 9/2004 Follo ..... B26B 21/443 30/50
10,538,005 B2 * 1/2020 Barrett ..... B26B 21/4031
2018/0009122 A1 * 1/2018 Bruce ..... B26B 21/225
2021/0299896 A1 * 9/2021 Hahn ..... B26B 21/16
2021/0339414 A1 * 11/2021 Smith ..... B26B 21/4012

FOREIGN PATENT DOCUMENTS

| | | | |
|---|---|---|---|
| DE | 10 2019 120 371 A1 * | 2/2021 | |
| GB | 2522273 A * | 7/2015 | |
| GB | 2524371 A * | 9/2015 | |
| WO | WO 2013/034902 A1 * | 3/2013 | |

OTHER PUBLICATIONS

Trendhunter—Finger-Worn Razors, from https://www.trendhunter.com/trends/mini-shaver, Nov. 20, 2013 (1 Page).
Aveline Smooth Woman's Razor with 6-BI . . . (1 Page).
Amazon.com: Gillette TREO Razor, Designed For Caregivers To Shave Someone Else (4 Pages).
Ti-Razor: The Titanium Three-finger Razor | Indegogo (2 Pages).
Introducing EvoShave—Melanie's Fab Finds (2 Pages).

* cited by examiner

*Primary Examiner* — Hwei-Siu C Payer
(74) *Attorney, Agent, or Firm* — Patshegen IP; Moshe Pinchas

(57) ABSTRACT

The present disclosed subject matter provides a razor blade head with finger slots, depressions (indentations) which extend into the razor blade head, for receiving human fingers, allowing for the razor blade head, typically attached to the handle of a razor, and therefore, the razor, to be manipulated with more precision, control, and force, than by using the handle alone.

15 Claims, 4 Drawing Sheets

RAZOR BLADE HEAD AND RAZOR FOR USE THEREWITH

CROSS REFERENCES TO RELATED APPLICATIONS

This application is related to and claims priority from commonly owned U.S. Provisional Patent Application Ser. No. 63/019,473, entitled: Razor Blade Head, filed on May 4, 2020, the disclosure of which is incorporated by reference in its entirety herein.

TECHNICAL FIELD

The present disclosure is directed to razors and other blade shaving devices, and in particular to razor blade heads.

BACKGROUND

Shaving is performed by both men and women. The razors used are typically disposable razors, with blade heads of one or more blades, or a handle that accepts a disposable blade head. Over time coupled with use, the blades of the razor become worn and dull. However, the aforementioned disposable razors and disposable blade heads are expensive, so most users use their razors with a blade head or the razor blade head on the razor handle, until the blades are completely dull, when the blades' cutting ability is minimal, and use of the blades is painful.

SUMMARY

The present disclosed subject matter provides a razor blade head with finger slots, depressions (indentations) which extend into the razor blade head, for receiving human fingers. These finger slots allow for the razor blade head, typically attached to the handle of a razor, and therefore, the razor, to be manipulated with more precision, control, and force (power), than by using the handle alone. As a result, a razor blade head, or razor having the razor blade head, can be used longer, typically beyond its normally usable life, while the blade(s) of the blade head lose their sharpness from use over time.

Unless otherwise defined herein, all technical and/or scientific terms used herein have the same meaning as commonly understood by one of ordinary skill in the art to which the disclosure pertains. Although methods and materials similar or equivalent to those described herein may be used in the practice or testing of embodiments of the disclosed subject matter, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE DRAWING FIGURES

Some embodiments of the disclosed subject matter are herein described, by way of example only, with reference to the accompanying drawings. With specific reference to the drawings in detail, it is stressed that the particulars shown are by way of example and for purposes of illustrative discussion of embodiments of the disclosed subject matter. In this regard, the description taken with the drawings makes apparent to those skilled in the art how embodiments of the disclosure may be practiced.

Attention is now directed to the drawings, where like reference numerals or characters indicate corresponding or like components. In the drawings.

DETAILED DESCRIPTION OF THE DRAWING FIGURES

In this document, references are made to directions such as upper, lower, upward, downward, top, bottom, inward, outward, front, rear, and lateral. These directional references are used to show example orientations of the disclosed subject matter, and are not limiting in any way.

Figure 1A:
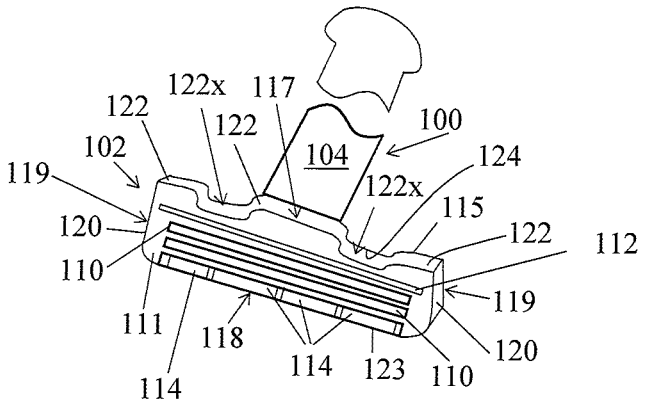
FIG. 1A is a perspective view of a razor with a blade head in accordance with an embodiment the disclosed subject matter.
Figure 1B:
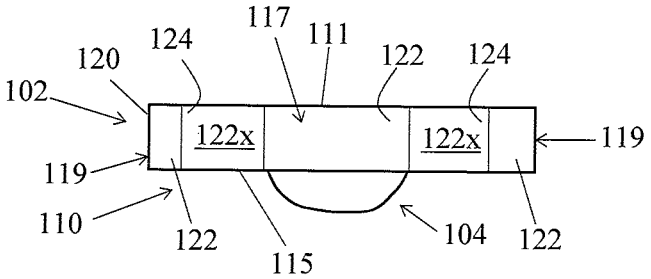
FIG. 1B is a top view of the razor with the blade head of FIG. 1A.

FIGS. 1A and 1B show the disclosed subject matter in use as part of a razor 100. The razor 100 is formed of a blade head (razor blade head) 102 and a handle 104. The blade head 102 may be removably attached to the handle 104, and, for example, may be disposable, or pivotally mounted to the handle 104, or as part of a unitary razor. The handle 104 is configured to be gripped and controlled by a user, so as to move the blade head 102 over the area of the body to be shaved, e.g., face, legs, head, armpits, ears, and other portions of the body known to have hair.

The blade head 102 includes one or more blades 110. The blade head 102, for example, serves as a frame for holding and/or otherwise supporting the one or more blades 110. The blades 110 are sharpened and exposed on the cutting or front side 111 of the blade head 102, so as to contact the skin during shaving. Optionally, the blade head 102 may include a strip 112 of lubricant, and an opening 114, both on the cutting side 111. The opening 114 allows shaved material, e.g., hair and the like, to pass through the blade head 102, and exit through the rear or non-blade side 115 of the blade head 102. The blade head 102, and, for example, the frame, includes an upper or top side 117, a lower or bottom side 118, and lateral sides 119.

The blade head 102 extends between lateral surfaces or edges 120 (of the respective lateral sides 119), and an upper or first surface or edge 122 and a lower or second surface or edge 123. One or more indented portions 122*x*, for example, two indented portions 122*x*, also known herein as "finger slots", are positioned along the upper surface 122 of the blade head 102, for example, along the top side 117. For example, the indented portions or finger slots 122*x*, are shaped to accommodate a finger, e.g., at least one finger, of a human user, when during shaving, one or more fingers, typically one finger (e.g., the finger tip), can seat in an indented portion 122*x*. By placing at least one finger into at least one indented portion 122*x* while shaving, the user has greater control including greater maneuverability of the blade head 102, when compared to just moving the blade head 102 with the handle 104. This allows greater precision and greater cutting force (power) of the blade head 102, allowing the user to get a quality, e.g., close, shave, even when the blade(s) are becoming dull and less sharp, from use over time, as well as exposure to the ambient environment over time. As a result, the blade head 102 is usable beyond what would be its normal life.

The surface 124 of the indented portions 122*x* may be modified to enhance the finger grip or friction. Such modifications to increase gripping and friction on the fingers may include protrusions, attached polymerized, rubber, or other surfaces, and/or rubberized, polymerized, or other material coatings. The indented portions 122*x* are shown as rounded, but may be circular, oval, straight, square, rectangular, triangular, or combinations thereof, including portions or segments, which are rounded, circular, oval, straight, square, rectangular, triangular, or combinations thereof, provided the finger or finger tip of the user is accommodated by the indented portion 122*x*.

Figure 2A:
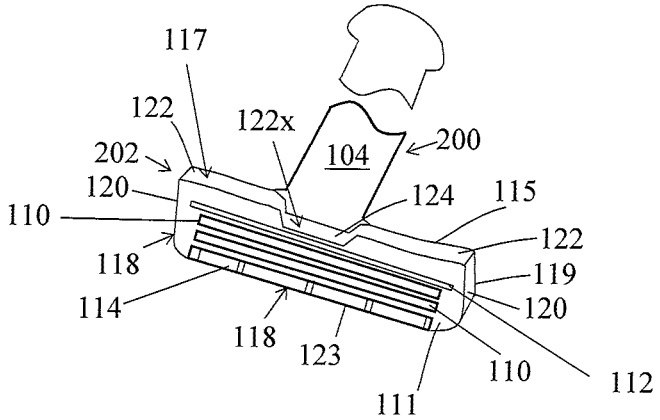
FIG. 2A is a perspective view of a razor with a blade head in accordance with another embodiment of the disclosed subject matter.
Figure 2B:
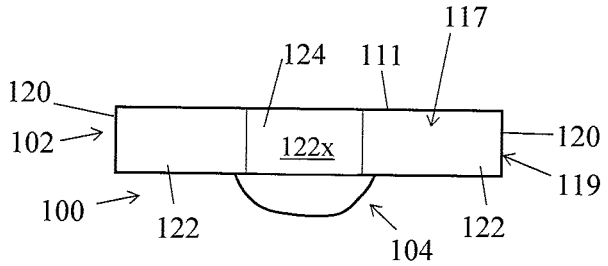
FIG. 2B is a top view of the razor with the blade head of FIG. 2A.
Figure 3A:
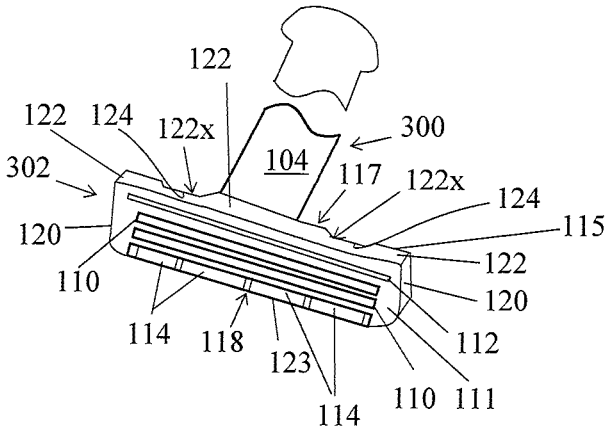
FIG. 3A is a perspective view of a razor with a blade head in accordance with another embodiment of the disclosed subject matter.
Figure 3B:
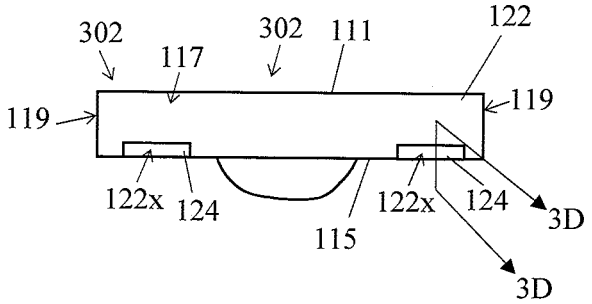
FIG. 3B is a top view of the razor with the blade head of FIG. 3A.
Figure 3C:
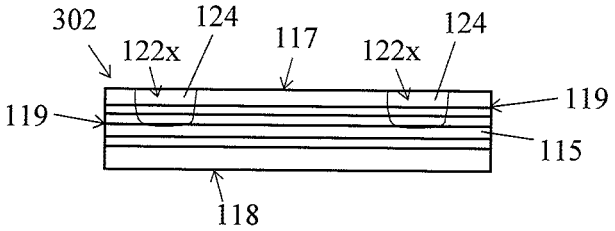
FIG. 3C is a rear view of the razor blade head of FIG. 3A.
Figure 3D:
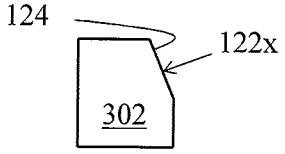
FIG. 3D is a cross-sectional view of the blade hear of the razor of FIG. 3A taken along line 3D-3D of FIG. 3B.

Another embodiment of a razor 200 is shown in FIGS. 2A and 2B, which includes a blade head 202, with an indented portion or finger slot 122*x*, positioned centrally or substantially centrally along the surface 122 of the top or upper side 117 of the blade head 202. The indented portion 122*x*, upper side 117 and other elements of the razor 200, blade head 202, and handle 104 are in accordance with the elements of the blade head 102 and the razor 100, as shown in FIGS. 1A and 1B, and described above. This single indented portion or finger slot 122*x* may be positioned anywhere along the top side 117 of the blade head 102. FIGS. 3A, 3B and 3C show another razor 300, which has a blade head 302, which includes two indented portions or finger slots 122*x* positioned along the surface 122 of the top or upper side 117 at the edge of the rear side 115 of the blade head 302. Optionally, and as shown, the indented portions 122*x* extend to the rear side 115 of the blade head 302, and are angled outward, from the top side 117, downward toward the rear side 115, for example, at an acute angle, as shown in FIG. 3D. The remainder of the blade head 302 and handle 104 are in accordance with the elements of the blade head 102 and/or handle 104 for the razor 100, as shown in FIGS. 1A and 1B, and as described above. The indented portions or finger slots 122*x* may be positioned anywhere along the top side 117, and optionally, the rear side 115, of the blade head 302, and there may be more than two indented portions 122*x*.

Figure 4A:
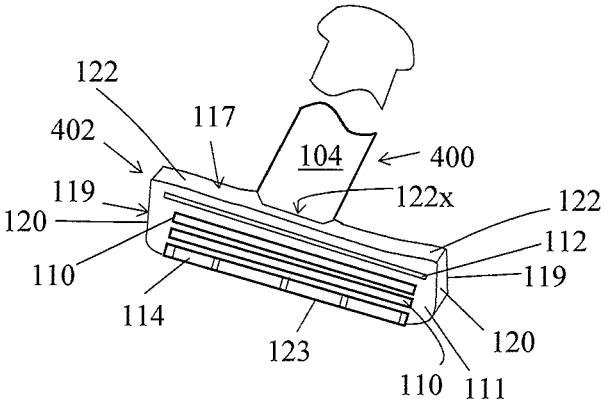
FIG. 4A is a perspective view of a razor with a blade head in accordance with another embodiment of the disclosed subject matter.
Figure 4B:
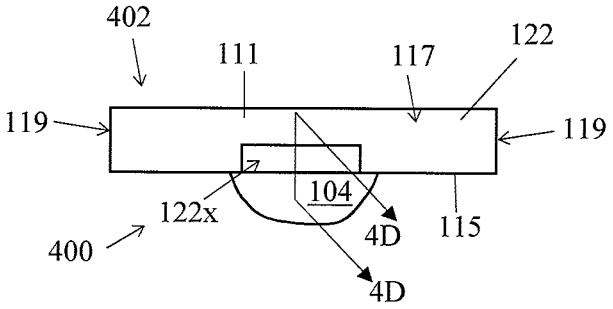
FIG. 4B is a top view of the razor with the blade head of FIG. 4A.
Figure 4C:
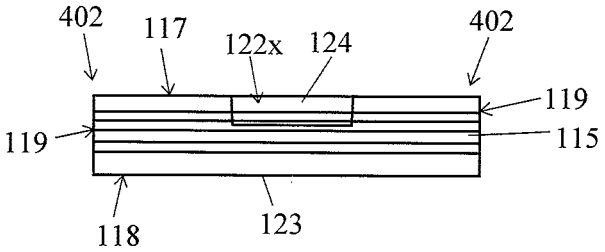
FIG. 4C is a rear view of the razor blade head of FIG. 4A.
Figure 4D:
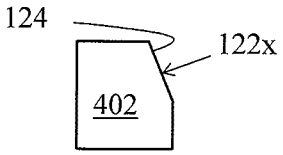
FIG. 4D is a cross-sectional view of the blade hear of the razor of FIG. 4A taken along line 4D-4D of FIG. 4B.

FIGS. 4A, 4B and 4C show another razor 400, which has a blade head 402, which includes an indented portion or finger slot 122*x* positioned centrally, or substantially centrally, along the surface 122 of the top or upper side 117 at the edge of the rear side 115 of the blade head 402. Optionally, and as shown, the indented portion 122*x* extends from the top side 117, downward, for example, at an acute angle, to the rear side 115 of the blade head 402, as shown in FIG. 4D. The remainder of the blade head 402 and handle 104 are in accordance with the elements of the blade head 102/302 and/or handle 104 for the razor 100/300, as shown, for example, in FIGS. 1A and 1B, and 3A-3D, and as described above. The indented portion or finger slot 122*x* may be positioned anywhere along the top side 117, and optionally, the rear side 115 of the blade head 402.

In other embodiments, indented portions or finger slots 122*x*, one or more, may be placed anywhere on the blade head. For example, one or more finger slots 122*x* may be placed on the rear side 115 of the blade head 102. For example, these rear side 115 finger slots may be circular in shape and semi-rounded or hemispherical when extending into the rear side 115 of the blade head 102. Additional indented portions or finger slots 122*x*, in addition to those shown for blade heads 102, 202, 302 and 402, may be placed on any of the blade heads 102, 202, 302, 402.

An example operation is now described for the razor 100 with the blade head 102 of FIGS. 1A and 1B. In operation, a user, while shaving, typically keeps some of his fingers wrapped around the handle 104 of the razor 100, and when more force (power), e.g., stronger movement and more downward pressure on the skin, or better control, including maneuverability of the blades 110, is needed, the user places, for example, one or both of his index and middle fingers into the respective indented portions (finger slots) 122*x*. With at least one finger seated in at least one of the indented portions 122*x*, the force and downward pressure is placed directly on the blade head 102, which results in greater force and downward pressure to be placed on the blades 110 (on the cutting side 111 of the blade head 102) for cutting with increased precision and control (for example, via increased maneuverability of the blade head 102), and/or increased hair removal, e.g., a closer shave. By controlling the razor 100 directly at the razor blade head blade 102, the user typically has a better shaving experience than with a razor maneuvered only by its handle.

Embodiments of the disclosed subject matter are directed to a razor blade head. The razor blade head comprises: a frame for supporting at least one blade; and, at least one indented portion extending into the frame and configured for receiving at least one finger of a user.

Optionally, the razor blade head is such that the frame includes an upper side and the at least one indented portion extends into the upper side. Optionally, the razor blade head is such that the at least one indented portion is positioned substantially centrally along the upper side. Optionally, the razor blade head is such that the at least one indented portion includes a plurality of indented portions extending along the upper side of the frame. Optionally, the razor blade head is such that the plurality of indented portions includes two indented portions positioned along the upper side, at substantially equal distances from each lateral side of the razor blade head. Optionally, the razor blade head is such that the at least one indented portion extending into the frame, includes a plurality of indented portions extending into the frame. Optionally, the razor blade head is such that the frame is configured for receiving a handle. Optionally, the razor blade head is such that it additionally comprises: a handle in communications with the frame. Optionally, the razor blade head is such that the at least one indented portion is at least partially rounded in shape. Optionally, the razor blade head is such that the at least one indented portion includes one or more straight portions. Optionally, the razor blade head is such that the at least one indented portion extends into the upper side and extends at an angle to a rear side of the frame. Optionally, the razor blade head is such that the at least one indented portion includes a plurality of indented portions, each of the indented portions extending into the upper side and at an angle to a rear side of the frame. Optionally, the razor blade head is such that the angle includes an acute angle. Optionally, the razor blade head is such that the at least one indented portion extends into a rear side the frame.

It is appreciated that certain features of the disclosure, which are, for clarity, described in the context of separate embodiments, may also be provided in combination in a single embodiment. Conversely, various features of the disclosure which are, for brevity, described in the context of a single embodiment, may also be provided separately or in any suitable sub-combination.

It will be appreciated by persons skilled in the art that the present disclosed subject matter is not limited to what has been particularly shown and described hereinabove. Rather the scope of the present disclosed subject matter is defined by the appended claims and includes both combinations and sub-combinations of the various features described hereinabove as well as variations and modifications thereof, which would occur to persons skilled in the art upon reading the foregoing description.

The invention claimed is:

1. A razor blade head comprising:

a frame for supporting at least one blade, the frame including:

a plurality of indented portions, each of the indented portions extending into an upper side of the frame to a rear side of the frame, at an acute angle with respect to the rear side of the frame, and each of the indented portions configured for receiving at least one finger of a user.

2. A razor comprising the razor blade head according to claim 1, and a handle coupled to the of the razor blade head.

3. The razor blade head of claim 1, wherein each of the indented portions is at least partially rounded in shape.

4. The razor blade head of claim 1, wherein each of the indented portions includes one or more straight portions.

5. The razor blade head of claim 1, wherein the upper side of the frame is adjacent to the rear side of the frame.

6. The razor blade head of claim 1, wherein each of the indented portions is spaced apart from each other along the frame.

7. The razor blade head of claim 1, wherein the plurality of indented portions includes two indented portions, spaced apart from oppositely disposed lateral sides of the frame, the lateral sides adjacent to: 1) the upper side, and, 2) the rear side, of the frame.

8. A razor blade head comprising:

a frame for supporting at least one blade, the frame including:

at least one indented portion extending into an upper side of the frame to a rear side of the frame, at an acute angle with respect to the rear side of the frame, and configured for receiving at least one finger of a user.

9. The razor blade head of claim 8, wherein the at least one indented portion is positioned substantially centrally along the upper side of the frame.

10. The razor blade head of claim 8, wherein the at least one indented portion includes a plurality of indented portions extending along the upper side of the frame.

11. The razor blade head of claim 10, wherein the plurality of indented portions includes two indented portions positioned along the upper side of the frame, at substantially equal distances from each lateral side of the frame.

12. The razor blade head of claim 8, wherein the at least one indented portion is at least partially rounded in shape.

13. The razor blade head of claim 8, wherein the at least one indented portion includes one or more straight portions.

14. A razor comprising the razor blade head according to claim 8, and a handle coupled to the frame of the razor blade head.

15. The razor blade head of claim 8, wherein the upper side of the frame is adjacent to the rear side of the frame.

* * * * *